US011781084B2

(12) United States Patent
Kamenoue et al.

(10) Patent No.: US 11,781,084 B2
(45) **Date of Patent: *Oct. 10, 2023**

(54) OIL AGENT ADDITIVE AND OIL AGENT COMPOSITION

(71) Applicant: KAO CORPORATION, Tokyo (JP)

(72) Inventors: Shogo Kamenoue, Wakayama (JP); Hiroshi Hori, Wakayama (JP); Takashi Wakasa, Wakayama (JP); Shunsuke Koriki, Wakayama (JP)

(73) Assignee: KAO CORPORATION, Tokyo (JP)

( * ) Notice: Subject to any disclaimer, the term of this patent is extended or adjusted under 35 U.S.C. 154(b) by 94 days.

This patent is subject to a terminal disclaimer.

(21) Appl. No.: 17/604,816

(22) PCT Filed: May 28, 2020

(86) PCT No.: PCT/JP2020/021213
§ 371 (c)(1),
(2) Date: Oct. 19, 2021

(87) PCT Pub. No.: WO2020/241787
PCT Pub. Date: Dec. 3, 2020

(65) Prior Publication Data

US 2022/0177801 A1 Jun. 9, 2022

(30) Foreign Application Priority Data

May 28, 2019 (JP) ..... 2019-099462

(51) Int. Cl.

| | |
|---|---|
| ***C10M 169/04*** | (2006.01) |
| ***C10M 129/08*** | (2006.01) |
| *C10N 30/06* | (2006.01) |
| *C10N 40/25* | (2006.01) |

(52) U.S. Cl.
CPC ..... *C10M 129/08* (2013.01); *C10M 169/04* (2013.01); *C10N 2030/06* (2013.01); *C10N 2040/25* (2013.01)

(58) Field of Classification Search
CPC ..... C10M 129/08; C10M 169/04; C10M 129/16; C10M 2203/1025; C10M 2207/04; C10N 2030/06; C10N 2040/25; C10N 2040/04
USPC ..... 508/583
See application file for complete search history.

(56) References Cited

U.S. PATENT DOCUMENTS

| | | | |
|---|---|---|---|
| 3,639,240 | A | 2/1972 | Mutchler |
| 4,719,084 | A | 1/1988 | Schmid et al. |
| 5,429,820 | A | 7/1995 | Kamitani et al. |
| 5,614,268 | A | 3/1997 | Varley et al. |
| 6,387,867 | B1 | 5/2002 | Ishikawa et al. |
| 9,296,942 | B2 | 3/2016 | Weerasooriya et al. |
| 10,045,529 | B2 | 8/2018 | Griese et al. |
| 2001/0012821 | A1 | 8/2001 | Koishikawa et al. |
| 2002/0025295 | A1 | 2/2002 | Kim |
| 2004/0266647 | A1 | 12/2004 | Kubo et al. |
| 2005/0037931 | A1 | 2/2005 | Rowland et al. |
| 2007/0155635 | A1 | 7/2007 | Tagawa et al. |
| 2010/0222603 | A1 | 9/2010 | Selifonov |
| 2010/0274039 | A1 | 10/2010 | Choi et al. |
| 2014/0298577 | A1 | 10/2014 | Burt et al. |
| 2015/0005225 | A1 | 1/2015 | Tulchinsky et al. |
| 2015/0133353 | A1 | 5/2015 | Arai et al. |
| 2015/0191672 | A1 | 7/2015 | Hanyuda et al. |
| 2016/0100574 | A1 | 4/2016 | Pesaro et al. |
| 2018/0371362 | A1 | 12/2018 | Keuleers et al. |

(Continued)

FOREIGN PATENT DOCUMENTS

| | | | |
|---|---|---|---|
| CN | 1826400 | A | 8/2006 |
| CN | 101412566 | A | 4/2009 |

(Continued)

OTHER PUBLICATIONS

International Preliminary Report on Patentability and English translation of the Written Opinion of the International Searching Authority for International Application No. PCT/JP2020/021174, dated Dec. 9, 2021.

(Continued)

*Primary Examiner* — Prem C Singh
*Assistant Examiner* — Francis C Campanell
(74) *Attorney, Agent, or Firm* — Birch, Stewart, Kolasch & Birch, LLP

(57) ABSTRACT

The present invention provides: an oil agent additive that is easily soluble in an oil agent and is outstandingly effective in reducing the friction coefficient; and an oil agent composition that contains the oil agent additive. This oil agent additive contains at least one compound represented by a Chemical Formula (1).

[Chemical Formula (1)]

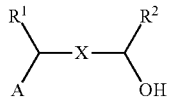

(In the formula: $R^1$ and $R^2$ are each an aliphatic hydrocarbon group with a carbon number of 1-33; the total carbon number of $R^1$ and $R^2$ is 2-34; X is a single bond or an aliphatic hydrocarbon group with a carbon number of 1-5; and A is —O—$CH_2$—CH(OH)—$CH_2$OH or —O—CH(—$CH_2$—OH)$_2$.)

20 Claims, No Drawings

(56) References Cited

U.S. PATENT DOCUMENTS

| | | | | |
|---|---|---|---|---|
| 2022/0144741 | A1* | 5/2022 | Kamenoue | C09D 5/00 |
| 2022/0213017 | A1* | 7/2022 | Kamenoue | C07C 43/13 |
| 2022/0213383 | A1* | 7/2022 | Kamenoue | C23F 11/12 |
| 2022/0220363 | A1* | 7/2022 | Kamenoue | C07C 41/03 |

FOREIGN PATENT DOCUMENTS

| | | | |
|---|---|---|---|
| CN | 101909744 | A | 12/2010 |
| CN | 104350137 | A | 2/2015 |
| CN | 107313271 | A | 11/2017 |
| JP | 53-137905 | A | 12/1978 |
| JP | 55-105632 | A | 8/1980 |
| JP | 62-235487 | A | 10/1987 |
| JP | 5-984 | A | 1/1993 |
| JP | 2002-235093 | A | 8/2002 |
| JP | 2007-146029 | A | 6/2007 |
| JP | 2008-506810 | A | 3/2008 |
| JP | 2010-260917 | A | 11/2010 |
| JP | 2012-506895 | A | 3/2012 |
| JP | 2014-25040 | A | 2/2014 |
| JP | 2015-501363 | A | 1/2015 |
| JP | 2015-124392 | A | 7/2015 |
| JP | 2016-56111 | A | 4/2016 |
| JP | 2016-148095 | A | 8/2016 |
| JP | 2017-197732 | A | 11/2017 |
| JP | 2018-104752 | A | 7/2018 |
| JP | 2018-172620 | A | 11/2018 |
| JP | 2019-6998 | A | 1/2019 |
| KR | 2001-0111811 | A | 12/2001 |
| WO | WO 00/43479 | A1 | 7/2000 |
| WO | WO 2005/018300 | A2 | 3/2005 |
| WO | WO 2007/062112 | A2 | 5/2007 |
| WO | WO 2010/049465 | A1 | 5/2010 |
| WO | WO 2013/062679 | A1 | 5/2013 |
| WO | WO 2017/090193 | A1 | 6/2017 |

OTHER PUBLICATIONS

International Preliminary Report on Patentability and English translation of the Written Opinion of the International Searching Authority for International Application No. PCT/JP2020/021194, dated Dec. 9, 2021.

International Preliminary Report on Patentability and English translation of the Written Opinion of the International Searching Authority for International Application No. PCT/JP2020/021208, dated Dec. 9, 2021.

International Preliminary Report on Patentability and English translation of the Written Opinion of the International Searching Authority for International Application No. PCT/JP2020/021211, dated Dec. 9, 2021.

International Preliminary Report on Patentability and English translation of the Written Opinion of the International Searching Authority for International Application No. PCT/JP2020/021213, dated Dec. 9, 2021.

"Synthesis and Application of Aliphatic Glycidyl Ethers," China Academic Journal Electronic Publishing House, 1995, pp. 15-21.

English translation of the Chinese Search Report for Chinese Application No. 202080030437.3, dated May 31, 2022.

Extended European Search Report for European Application No. 20812820.7, dated Jul. 1, 2022.

Extended European Search Report for European Application No. 20813026.0, dated Jul. 1, 2022.

Extended European Search Report for European Application No. 20813622.6, dated Jul. 1, 2022.

Extended European Search Report for European Application No. 20814785.0, dated Jun. 24, 2022.

English translation of the Chinese Search Report for Chinese Application No. 202080032131.1, dated Aug. 23, 2022.

Lai et al., "Surfactants and Detergents," Advances in Fine Petrochemicals, vol. 11, No. 3, 1997, 53 pages total, with an English translation.

International Search Report for International Application No. PCT/JP2020/021174, dated Aug. 11, 2020.

International Search Report for International Application No. PCT/JP2020/021194, dated Aug. 18, 2020.

International Search Report for International Application No. PCT/JP2020/021208, dated Aug. 25, 2020.

International Search Report for International Application No. PCT/JP2020/021211, dated Aug. 18, 2020.

International Search Report for International Application No. PCT/JP2020/021213, dated Jul. 21, 2020.

U.S. Appl. No. 17/605,729, filed Oct. 22, 2021.

U.S. Appl. No. 17/605,740, filed Oct. 22, 2021.

U.S. Appl. No. 17/605,7059, filed Oct. 22, 2021.

U.S. Appl. No. 17/605,921, filed Oct. 22, 2021.

Extended European Search Report for corresponding European Application No. 20813720.8, dated Jun. 30, 2023.

* cited by examiner

OIL AGENT ADDITIVE AND OIL AGENT COMPOSITION

TECHNICAL FIELD

The present invention relates to an oil agent additive, and an oil agent composition containing the oil agent additive and an oil agent.

BACKGROUND ART

Ether alcohols obtained by reaction of an epoxy alkane with a polyhydric alcohol are useful as raw materials for an emulsifier, a surfactant, and the like.

For example, Patent Document 1 discloses an ether alcohol obtained by reaction of an epoxy alkane having 8 to 20 carbon atoms with a mono- or polyfunctional alcohol having 1 to 10 carbon atoms and 1 to 4 alcoholic hydroxyl groups.

On the other hand, Patent Document 2 discloses a lubricating oil composition for an internal combustion engine containing a monoglyceride having a hydrocarbon group with 8 to 22 carbon atoms (a glycerin fatty acid ester in which a fatty acid is ester-bonded to one of three hydroxyl groups of glycerin).

The monoglyceride is added to a lubricating oil composition as a friction modifier.

PRIOR ART DOCUMENTS

Patent Document

Patent Document 1: JP-A-55-105632
Patent Document 2: JP-A-2014-25040

SUMMARY OF THE INVENTION

Problems to be Solved by the Invention

However, unfortunately, the monoglyceride described in Patent Document 2 is hardly soluble in a lubricating oil, and the monoglyceride is precipitated in a lubricating oil composition when the added amount is increased in order to reduce the friction coefficient.

The present invention has been made in view of the above circumstances, and provides an oil agent additive that is easily soluble in an oil agent and has an excellent effect of reducing the friction coefficient, and an oil agent composition containing the oil agent additive.

Means for Solving the Problems

As a result of intensive studies, the present inventors have found that the above problems can be solved by a compound having a specific structure.

The present invention relates to an oil agent additive comprising at least one kind of a compound represented by a Chemical Formula (1):

[Chemical Formula (1)]

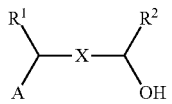

wherein $R^1$ and $R^2$ are each an aliphatic hydrocarbon group having 1 or more and 33 or less carbon atoms, a total number of carbon atoms of $R^1$ and $R^2$ is 2 or more and 34 or less, X is a single bond or an aliphatic hydrocarbon group having 1 or more and 5 or less carbon atoms, and A is —O—$CH_2$—CH(OH)—$CH_2$OH or —O—CH(—$CH_2$—OH)$_2$.

Effect of the Invention

Monoglycerides that have been used as conventional lubricating oil additives form an oil film and reduce friction when the hydroxyl group of the monoglycerides is adsorbed to metal, and the linear alkyl group of the monoglycerides is directed to the lubricating oil side. In order to form a stronger oil film and improve the effect of reducing the friction coefficient, it is necessary to lengthen the linear alkyl group of monoglycerides. However, it is considered that the longer the linear alkyl group of monoglycerides is, the higher the melting point of the monoglycerides is, and therefore the solubility of the monoglycerides in a lubricating oil decreases.

On the other hand, since the compound represented by the Chemical Formula (1) of the present invention has a characteristic structure having a glyceryl ether group and a hydroxyl group in the carbon chain, it is considered that the compound has a low melting point, is excellent in solubility in an oil agent, and also is excellent in the effect of reducing the friction coefficient.

MODE FOR CARRYING OUT THE INVENTION

Hereinafter, a detailed described is made of the present invention.

<Oil Agent Additive>

The oil agent additive of the present invention contains at least one kind of a compound represented by the following Chemical Formula (1) (hereinafter, also referred to as ether alcohol). In addition, the oil agent additive of the present invention may be composed of a compound represented by the following Chemical Formula (1). In addition, the oil agent additive of the present invention may be composed of one or more kinds of a compound represented by the following Chemical Formula (1).

[Chemical Formula (1)]

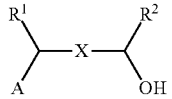

(In Chemical Formula (1), $R^1$ and $R^2$ are each an aliphatic hydrocarbon group having 1 or more and 33 or less carbon atoms, a total number of carbon atoms of $R^1$ and $R^2$ is 2 or more and 34 or less, X is a single bond or an aliphatic hydrocarbon group having 1 or more and 5 or less carbon atoms, and A is —O—$CH_2$—CH(OH)—$CH_2$OH or —O—CH(—$CH_2$—OH)$_2$.)

$R^1$ and $R^2$ are each an aliphatic hydrocarbon group having 1 or more and 33 or less carbon atoms, preferably a linear alkyl group or a branched alkyl group (also referred to as a branched chain alkyl group), more preferably a linear alkyl group from the viewpoint of reducing the friction coefficient. The aliphatic hydrocarbon group may have a substituent such as a hydroxy group, a ketone group, a carboxy group, an aryl group, or an alkoxy group as long as the effect of the present invention is not impaired. $R^1$ and $R^2$ may be the same aliphatic hydrocarbon groups as each other or different aliphatic hydrocarbon groups from each other. In addition, the total number of substituents of $R^1$ and $R^2$ is preferably 5 or less, more preferably 3 or less, further preferably 1 or less, still more preferably 0 (that is, having no substituent) from the viewpoint of solubility in an oil agent.

The total number of carbon atoms of $R^1$ and $R^2$ is 2 or more and 34 or less, or from the viewpoint of reducing the friction coefficient, preferably 12 or more, more preferably 14 or more, further preferably 16 or more, or from the viewpoint of solubility in an oil agent, preferably 22 or less, more preferably 20 or less, further preferably 18 or less, still more preferably 16 or less.

X is a single bond or an aliphatic hydrocarbon group having 1 or more and 5 or less carbon atoms, or from the viewpoint of production efficiency and ease of production, preferably a single bond or an aliphatic hydrocarbon group having 1 or more and 3 or less carbon atoms, more preferably a single bond or an aliphatic hydrocarbon group having 1 or more and 2 or less carbon atoms, further preferably a single bond or an aliphatic hydrocarbon group having 1 carbon atom, still more preferably a single bond.

The total number of carbon atoms of $R^1$, $R^2$, and X is 2 or more and 39 or less, or from the viewpoint of reducing the friction coefficient, preferably 12 or more, more preferably 14 or more, further preferably 16 or more, or from the viewpoint of solubility in an oil agent, preferably 24 or less, more preferably 22 or less, further preferably 20 or less, still more preferably 18 or less, still more preferably 16 or less.

When X is an aliphatic hydrocarbon group, from the viewpoint of production efficiency and ease of production, X is preferably a linear alkyl group or a branched alkyl group, more preferably a linear alkyl group.

From the viewpoint of production efficiency and ease of production, X is preferably

*—$(CH_2)_n$—* (n is 0 or more and 5 or less, and * represents a binding site), wherein n is preferably 0 or more, preferably 3 or less, more preferably 2 or less, further preferably 1 or less, still more preferably 0, that is, a single bond.

From the viewpoint of production efficiency and ease of production, the oil agent additive preferably contains two or more kinds of the compound, between which the total numbers of carbon atoms of $R^1$ and $R^2$ are the same, but the numbers of carbon atoms of $R^1$ and the numbers of carbon atoms of $R^2$ are each different.

From the viewpoint of production efficiency and ease of production, the oil agent additive preferably contains two or more kinds of the compound, between which the total numbers of carbon atoms of $R^1$, $R^2$ and X are the same, but the numbers of carbon atoms of $R^1$ and the numbers of carbon atoms of $R^2$ are each different.

From the viewpoint of production efficiency and ease of production, the oil agent additive preferably contains two or more kinds of the compound in which X is a single bond or an aliphatic hydrocarbon group having 1 or more and 3 or less carbon atoms, and between which the total numbers of carbon atoms of $R^1$ and $R^2$ are the same, but the numbers of carbon atoms of $R^1$ and the numbers of carbon atoms of $R^2$ are each different.

From the viewpoint of production efficiency and ease of production, the oil agent additive preferably contains two or more kinds of the compound in which X is a single bond or an aliphatic hydrocarbon group having 1 or more and 3 or less carbon atoms, and between which the total numbers of carbon atoms of $R^1$, $R^2$ and X are the same, but the numbers of carbon atoms of $R^1$ and the numbers of carbon atoms of $R^2$ are each different.

From the viewpoint of production efficiency and ease of production, the oil agent additive more preferably contains two or more kinds of the compound in which X is a single bond or an aliphatic hydrocarbon group having 1 or more and 2 or less carbon atoms, and between which the total numbers of carbon atoms of $R^1$ and $R^2$ are the same, but the numbers of carbon atoms of $R^1$ and the numbers of carbon atoms of $R^2$ are each different.

From the viewpoint of production efficiency and ease of production, the oil agent additive more preferably contains two or more kinds of the compound in which X is a single bond or an aliphatic hydrocarbon group having 1 or more and 2 or less carbon atoms, and between which the total numbers of carbon atoms of $R^1$, $R^2$ and X are the same, but the numbers of carbon atoms of $R^1$ and the numbers of carbon atoms of $R^2$ are each different.

From the viewpoint of production efficiency and ease of production, the oil agent additive further preferably contains two or more kinds of the compound in which X is a single bond or an aliphatic hydrocarbon group having 1 carbon atom, and between which the total numbers of carbon atoms of $R^1$ and $R^2$ are the same, but the numbers of carbon atoms of $R^1$ and the numbers of carbon atoms of $R^2$ are each different.

From the viewpoint of production efficiency and ease of production, the oil agent additive further preferably contains two or more kinds of the compound in which X is a single bond or an aliphatic hydrocarbon group having 1 carbon atom, and between which the total numbers of carbon atoms of $R^1$, $R^2$ and X are the same, but the numbers of carbon atoms of $R^1$ and the numbers of carbon atoms of $R^2$ are each different.

From the viewpoint of production efficiency and ease of production, the oil agent additive still more preferably contains two or more kinds of the compound in which X is a single bond, and between which the total numbers of carbon atoms of $R^1$ and $R^2$ are the same, but the numbers of carbon atoms of $R^1$ and the numbers of carbon atoms of $R^2$ are each different.

When the oil agent additive contains two or more kinds of the compound in which X is a single bond and between which the total numbers of carbon atoms of $R^1$ and $R^2$ are different, the total content of the compound in which the total number of carbon atoms of $R^1$ and $R^2$ is 14 and the compound in which the total number of carbon atoms of $R^1$ and $R^2$ is 16 is preferably 75 mass % or more, more preferably 85 mass- or more, further preferably 95 mass % or more, still more preferably 100 mass % from the viewpoint of solubility in an oil agent.

When the oil agent additive contains two or more kinds of the compound represented by the Chemical Formula (1) between which the total numbers of carbon atoms of $R^1$ and $R^2$ are the same, but the numbers of carbon atoms of $R^1$ and the numbers of carbon atoms of $R^2$ are each different, the content ratio of the compound in which the number of carbon atoms of $R^1$ is 5 or more and the number of carbon atoms of $R^2$ is 5 or more is preferably 10 mass % or more, more preferably 20 mass %, or more, further preferably 30 mass- or more, and preferably 90 mass % or less, more preferably 80 mass % or less, further preferably 70 mass % or less from the viewpoint of solubility in an oil agent.

From the viewpoint of solubility in an oil agent, the melting point of the ether alcohol is preferably 30° C. or lower, more preferably 20° C. or lower, further preferably 10° C. or lower, and may be −200° C. or higher.

The method for producing the ether alcohol is not particularly limited. For example, the ether alcohol can be produced by oxidizing the double bond in an internal olefin with a peroxide such as hydrogen peroxide, performic acid, or peracetic acid to synthesize an internal epoxide, and reacting the obtained internal epoxide with glycerin. In the case of a mixture in which the total numbers of carbon atoms of internal olefins are constant but the double bonds are present at different positions, the compound represented by the Chemical Formula (1) obtained by the above producing method is a mixture of a plurality of compounds in which X is a single bond and between which the total numbers of carbon atoms of $R^1$ and $R^2$ are the same, but the numbers of carbon atoms of $R^1$ and the numbers of carbon atoms of $R^2$ are each different. The compound represented by the Chemical Formula (1) obtained by the above producing method is usually a mixture of a compound 1 in which the A is —O—$CH_2$—CH(OH)—$CH_2$OH (hereinafter, also referred to as ether alcohol 1) and a compound 2 in which the A is —O—CH(—$CH_2$—OH), (hereinafter, also referred to as ether alcohol 2).

The internal olefin used for the production of the ether alcohol may contain a terminal olefin. In this case, the content of terminal olefin contained in olefin is, for example, 0.1 mass % or more, 0.2 mass % or more, and 5 mass % or less, 3 mass % or less, 2 mass % or less, 1 mass % or less, 0.5 mass % or less.

When the oil agent additive contains the ether alcohol 1 and the ether alcohol 2, the content of the ether alcohol 1 is preferably 1 mass % or more, more preferably 30 mass % or more, further preferably 40 mass % or more, still more preferably 50 mass % or more, and preferably 99 mass % or less, more preferably 90 mass- or less, further preferably 80 mass % or less with respect to the total amount of the ether alcohol 1 and the ether alcohol 2, from the viewpoint of reducing the friction coefficient. From the same viewpoint, the content is preferably 1 to 99 mass %, more preferably 30 to 99 mass %, further preferably 40 to 90 mass %, still more preferably 50 to 80 mass %.

The oil agent additive can be obtained as one kind of the compound represented by the Chemical Formula (1), a mixture of two or more kinds of the compound represented by the Chemical Formula (1), or a mixture of the above compound and a trace component other than olefin contained in the raw material olefin and a derivative thereof.

The oil agent additive can be suitably used as a lubricating oil additive or a friction coefficient reducing agent.

In addition, the oil agent additive can be suitably used for reducing the friction coefficient of an engine or a gear.

<Oil Agent Composition>

The oil agent composition of the present invention contains at least an oil agent and the oil agent additive.

The melting point of the oil agent is preferably −200° C. or higher, and preferably −15° C. or lower, more preferably −30° C. or lower, further preferably −45° C. or lower, still more preferably −60° C. or lower from the viewpoint of ease of handling. The melting point of the oil agent can be measured using a high sensitivity type differential scanning calorimeter (manufactured by Hitachi High-Tech Science Corporation, trade name: DSC 7000X).

The oil agent can be used without particular limitation, and is preferably a lubricating oil from the viewpoint of lubricity. Examples of the lubricating oil include an engine oil and a gear oil. The oil agent is preferably a paraffinic lubricating oil.

The content of the oil agent additive in the oil agent composition is not particularly limited, but is preferably 0.05 mass- or more, more preferably 0.1 mass % or more, further preferably 0.2 mass- or more, still more preferably 0.5 mass % or more, and preferably 20 mass % or less, more preferably 10 mass' or less, further preferably 5 mass- or less from the viewpoint of decreasing the friction coefficient.

The oil agent composition may contain various additives as necessary. Examples of the additive include an antioxidant, a metal inactivator, an anti-wear agent, an antifoaming agent, a viscosity index improver, a pour point depressant, a clean dispersant, a rust inhibitor, and publicly known oil agent additives.

The present invention and preferred embodiments of the present invention are described below.

<1>

An oil agent additive comprising at least one kind of a compound represented by a Chemical Formula (1):

[Chemical Formula (1)]

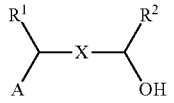

wherein $R^1$ and $R^2$ are each an aliphatic hydrocarbon group having 1 or more and 33 or less carbon atoms, a total number of carbon atoms of $R^1$ and $R^2$ is 2 or more and 34 or less, X is a single bond or an aliphatic hydrocarbon group having 1 or more and 5 or less carbon atoms, and A is —O—$CH_2$—CH(OH)—$CH_2$OH or —O—CH(—$CH_2$—OH)$_2$.

<2>

An oil agent additive comprising at least one kind of a compound represented by a Chemical Formula (1):

[Chemical Formula (1)]

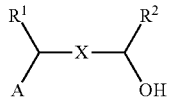

wherein $R^1$ and $R^2$ are each an aliphatic hydrocarbon group having 1 or more and 33 or less carbon atoms, X is a single bond or an aliphatic hydrocarbon group having 1 or more and 5 or less carbon atoms, a total number of carbon atoms of $R^1$, $R^2$ and X is 2 or more and 39 or less, and A is —O—$CH_2$—CH(OH)—$CH_2$OH or —O—CH(—$CH_2$—OH)$_2$.

<3>

The oil agent additive according to <1> or <2>, wherein $R^1$ and $R^2$ are each a linear alkyl group or a branched alkyl group.

<4>

The oil agent additive according to <1> or <2>, wherein $R^1$ and $R^2$ are each a linear alkyl group.

<5>

The oil agent additive according to any one of <1> to <4>, wherein a total number of carbon atoms of $R^1$ and $R^2$ is preferably 12 or more, more preferably 14 or more, further preferably 16 or more, and preferably 22 or less, more preferably 20 or less, further preferably 18 or less, still more preferably 16 or less.

<6>

The oil agent additive according to any one of <1> to <4>, wherein a total number of carbon atoms of $R^1$ and $R^2$ is preferably 12 or more and 22 or less, more preferably 14 or more and 22 or less, further preferably 16 or more and 22 or less.

<7>

The oil agent additive according to any one of <1> to <4>, wherein a total number of carbon atoms of $R^1$ and $R^2$ is preferably 12 or more and 20 or less, more preferably 14 or more and 20 or less, further preferably 16 or more and 20 or less.

<8>

The oil agent additive according to any one of <1> to <4>, wherein a total number of carbon atoms of $R^1$ and $R^2$ is preferably 12 or more and 18 or less, more preferably 14 or more and 18 or less, further preferably 16 or more and 18 or less.

<9>

The oil agent additive according to any one of <1> to <4>, wherein a total number of carbon atoms of $R^1$ and $R^2$ is preferably 12 or more and 16 or less, more preferably 14 or more and 16 or less, further preferably 16.

<10>

The oil agent additive according to any one of <1> to <9>, wherein in the compound represented by the Chemical Formula (1), X is a single bond or an aliphatic hydrocarbon group having 1 or more and 3 or less carbon atoms.

<11>

The oil agent additive according to any one of <1> to <9>, wherein in the compound represented by the Chemical Formula (1), X is a single bond or an aliphatic hydrocarbon group having 1 or more and 2 or less carbon atoms.

<12>

The oil agent additive according to any one of <1> to <9>, wherein in the compound represented by the Chemical Formula (1), X is a single bond or an aliphatic hydrocarbon group having 1 carbon atom.

<13>

The oil agent additive according to any one of <1> to <9>, wherein in the compound represented by the Chemical Formula (1), X is a single bond.

<14>

The oil agent additive according to any one of <1> to <9>, wherein in the compound represented by the Chemical Formula (1), X is preferably a linear alkyl group or a branched alkyl group, more preferably a linear alkyl group.

<15>

The oil agent additive according to any one of <1> to <9>, wherein in the compound represented by the Chemical Formula (1), X is preferably

*—$(CH_2)_n$—* (n is 0 or more and 5 or less, and * represents a binding site), wherein n is preferably 0 or more, preferably 3 or less, more preferably 2 or less, further preferably 1 or less, still more preferably 0, that is, a single bond.

<16>

The oil agent additive according to any one of <1> to <15>, wherein a total number of carbon atoms of $R^1$, $R^2$, and X is 2 or more and 39 or less, preferably 12 or more, more preferably 14 or more, further preferably 16 or more, and preferably 24 or less, more preferably 22 or less, further preferably 20 or less, still more preferably 18 or less, still more preferably 16 or less.

<17>

The oil agent additive according to any one of <1> to <9>, comprising two or more kinds of the compound in which X is a single bond or an aliphatic hydrocarbon group having 1 or more and 3 or less carbon atoms, and between which the total numbers of carbon atoms of $R^1$ and $R^2$ are the same, but the numbers of carbon atoms of $R^1$ and the numbers of carbon atoms of $R^2$ are each different.

<18>

The oil agent additive according to any one of <1> to <9>, comprising two or more kinds of the compound in which X is a single bond or an aliphatic hydrocarbon group having 1 or more and 3 or less carbon atoms, and between which the total numbers of carbon atoms of $R^1$, $R^2$ and X are the same, but the numbers of carbon atoms of $R^1$ and the numbers of carbon atoms of $R^2$ are each different.

<19>

The oil agent additive according to any one of <1> to <9>, comprising two or more kinds of the compound in which X is a single bond or an aliphatic hydrocarbon group having 1 or more and 2 or less carbon atoms, and between which the total numbers of carbon atoms of $R^1$ and $R^2$ are the same, but the numbers of carbon atoms of $R^1$ and the numbers of carbon atoms of $R^2$ are each different.

<20>

The oil agent additive according to any one of <1> to <9>, comprising two or more kinds of the compound in which X is a single bond or an aliphatic hydrocarbon group having 1 or more and 2 or less carbon atoms, and between which the total numbers of carbon atoms of $R^1$, $R^2$ and X are the same, but the numbers of carbon atoms of $R^1$ and the numbers of carbon atoms of $R^2$ are each different.

<21>

The oil agent additive according to any one of <1> to <9>, comprising two or more kinds of the compound in which X is a single bond or an aliphatic hydrocarbon group having 1 carbon atom, and between which the total numbers of carbon atoms of $R^1$ and $R^2$ are the same, but the numbers of carbon atoms of $R^1$ and the numbers of carbon atoms of $R^2$ are each different.

<22>

The oil agent additive according to any one of <1> to <9>, comprising two or more kinds of the compound in which X is a single bond or an aliphatic hydrocarbon group having 1 carbon atom, and between which the total numbers of carbon atoms of $R^1$, $R^2$ and X are the same, but the numbers of carbon atoms of $R^1$ and the numbers of carbon atoms of $R^2$ are each different.

<23>

The oil agent additive according to any one of <1> to <9>, comprising two or more kinds of the compound in which X is a single bond, and between which the total numbers of carbon atoms of $R^1$ and $R^2$ are the same, but the numbers of carbon atoms of $R^1$ and the numbers of carbon atoms of $R^2$ are each different.

<24>

The oil agent additive according to any one of <1> to <4>, comprising two or more kinds of the compound in which X is a single bond and between which the total numbers of carbon atoms of $R^1$ and $R^2$ are different, wherein a total content of the compound in which the total number of carbon atoms of $R^1$ and $R^2$ is 14 and the compound in which the total number of carbon atoms of $R^1$ and $R^2$ is 16 is preferably 75 mass- or more, more preferably 85 mass % or more, further preferably 95 mass % or more, still more preferably 100 mass %.

<25>

The oil agent additive according to any one of <1> to <23>, comprising two or more kinds of the compound between which the total numbers of carbon atoms of $R^1$ and $R^2$ are the same, but the numbers of carbon atoms of $R^1$ and the numbers of carbon atoms of $R^2$ are each different, wherein a content ratio of the compound in which $R^1$ has 5 or more carbon atoms and $R^2$ has 5 or more carbon atoms is preferably 10 masse or more, more preferably 20 mass % or more, further preferably 30 mass % or more, and preferably 90 mass or less, more preferably 80 mass or less, further preferably 70 mass % or less.

<26>

The oil agent additive according to any one of <1> to <23>, comprising two or more kinds of the compound between which the total numbers of carbon atoms of $R^1$ and $R^2$ are the same, but the numbers of carbon atoms of $R^1$ and the numbers of carbon atoms of $R^2$ are each different, wherein a content ratio of the compound in which $R^1$ has 5 or more carbon atoms and $R^2$ has 5 or more carbon atoms is 10 mass % or more and 90 mass % or less.

<27>

The oil agent additive according to any one of <1> to <23>, comprising two or more kinds of the compound between which the total numbers of carbon atoms of $R^1$ and $R^2$ are the same, but the numbers of carbon atoms of $R^1$ and the numbers of carbon atoms of $R^2$ are each different, wherein a content ratio of the compound in which $R^1$ has 5 or more carbon atoms and $R^2$ has 5 or more carbon atoms is 20 mass % or more and 80 mass % or less.

<28>

The oil agent additive according to any one of <1> to <23>, comprising two or more kinds of the compound between which the total numbers of carbon atoms of $R^1$ and $R^2$ are the same, but the numbers of carbon atoms of $R^1$ and the numbers of carbon atoms of $R^2$ are each different, wherein a content ratio of the compound in which $R^1$ has 5 or more carbon atoms and $R^2$ has 5 or more carbon atoms is 30 mass % or more and 70 mass % or less.

<29>

The oil agent additive according to any one of <1> to <28>, wherein a melting point of the compound represented by the Chemical Formula (1) is 30° C. or lower.

<30>

The oil agent additive according to any one of <1> to <28>, wherein a melting point of the compound represented by the Chemical Formula (1) is 20° C. or lower.

<31>

The oil agent additive according to any one of <1> to <28>, wherein a melting point of the compound represented by the Chemical Formula (1) is 10° C. or lower.

<32>

The oil agent additive according to any one of <1> to <31>, wherein an internal olefin used for the production of the compound represented by the Chemical Formula (1) contains a terminal olefin, a content of the terminal olefin contained in olefin is 0.1 mass % or more, 0.2 mass, or more, and 5 mass % or less, 3 mass % or less, 2 mass % or less, 1 mass % or less, 0.5 mass % or less.

<33>

The oil agent additive according to any one of <1> to <32>, comprising a compound 1 (ether alcohol 1) in which A is —O—$CH_2$—CH(OH)—$CH_2$OH in the Chemical Formula (1) and a compound 2 (ether alcohol 2) in which A is —O—CH(—$CH_2$—OH)$_2$ in the Chemical Formula (1).

<34>

The oil agent additive according to any one of <1> to <33>, wherein a content of the ether alcohol 1 is preferably 1 mass % or more, more preferably 30 mass % or more, further preferably 40 mass % or more, still more preferably 50 mass % or more, and preferably 99 mass % or less, more preferably 90 masse or less, further preferably 80 mass %, or less with respect to a total amount of the ether alcohol 1 and the ether alcohol 2.

<35>

The oil agent additive according to any one of <1> to <33>, wherein a content of the ether alcohol 1 is 1 to 99 mass % with respect to a total amount of the ether alcohol 1 and the ether alcohol 2.

<36>

The oil agent additive according to any one of <1> to <33>, wherein a content of the ether alcohol 1 is 30 to 99 mass % with respect to a total amount of the ether alcohol 1 and the ether alcohol 2.

<37>

The oil agent additive according to any one of <1> to <33>, wherein a content of the ether alcohol 1 is 40 to 90 mass % with respect to a total amount of the ether alcohol 1 and the ether alcohol 2.

<38>

The oil agent additive according to any one of <1> to <33>, wherein a content of the ether alcohol 1 is 50 to 80 mass %, with respect to a total amount of the ether alcohol 1 and the ether alcohol 2.

<39>

Use of the oil agent additive according to any one of <1> to <38> as a lubricating oil additive.

<40>

Use of the oil agent additive according to any one of <1> to <38> as a friction coefficient reducing agent.

<41>

Use of the oil agent additive according to any of <1> to <38> for reducing a friction coefficient of an engine or a gear.

<42>

An oil agent composition comprising the oil agent additive according to any one of <1> to <38> and an oil agent.

<43>

The oil agent composition according to <42>, wherein a melting point of the oil agent is preferably −200° C. or higher, and preferably −15° C. or lower, more preferably −30° C. or lower, further preferably −45° C. or lower, still more preferably −60° C. or lower.

<44>

The oil agent composition according to <42> or <43>, wherein the oil agent is a lubricating oil.

<45>

The oil agent composition according to <44>, wherein the lubricating oil is an engine oil or a gear oil.

<46>

The oil agent composition according to <44> or <45>, wherein the lubricating oil is a paraffinic lubricating oil.

<47>

The oil agent composition according to any one of <42> to <46>, wherein a content of the oil agent additive in the oil agent composition is preferably 0.05 mass % or more, more preferably 0.1 mass % or more, further preferably 0.2 mass % or more, still more preferably 0.5 mass' or more, and preferably 20 mass % or less, more preferably 10 mass % or less, further preferably 5 mass % or less.

<48>

The oil agent composition according to any one of <42> to <46>, wherein a content of the oil agent additive in the oil agent composition is 0.05 mass or more and 20 mass- or less.

<49>

The oil agent composition according to any one of <42> to <46>, wherein a content of the oil agent additive in the oil agent composition is 0.1 mass % or more and 10 mass or less.

<50>

The oil agent composition according to any one of <42> to <46>, wherein a content of the oil agent additive in the oil agent composition is 0.2 mass % or more and 5 mass % or less.

<51>

The oil agent composition according to any one of <42> to <46>, wherein a content of the oil agent additive in the oil agent composition is 0.5 mass % or more and 5 mass %, or less.

EXAMPLES

Hereinafter, a specific description is made of the present invention with reference to Examples. The content of each component is expressed in mass % unless otherwise indicated in Tables. Various measuring methods are as follows.

<Method for Measuring Double Bond Distribution in Olefin>

The double bond distribution in olefin was measured by gas chromatography (hereinafter, abbreviated as GC). Specifically, dimethyl disulfide was reacted with olefin to form a dithioated derivative, and then respective components were separated by GC. The double bond distribution in olefin was determined from respective peak areas. The apparatus used for measurement and analyzing conditions are as follows.

GC apparatus: Trade name HP6890 (manufactured by Hewlett-Packard Company)

Column: Trade name Ultra-Alloy-1 HT capillary column 30 m×250 μm×0.15 μm (manufactured by Frontier Laboratories, Ltd.)

Detector: Hydrogen flame ion detector (FID)

Injection temperature: 300° C.

Detector temperature: 350° C.

Oven: 60° C. (0 min.)→2° C./min.→225° C.→20° C./min.→350° C.→350° C. (5.2 min.)

<Method for Measuring Content Ratio of Structural Isomer>

Measurement was performed by $^{1}$H-NMR for a mixture of 0.05 g of alkyl glyceryl ether, 0.2 g of trifluoroacetic anhydride, and 1 g of deuterated chloroform. Measuring conditions are as follows.

Nuclear magnetic resonance apparatus: Agilent 400-MR DD2, manufactured by Agilent Technologies, Inc.

Observation range: 6410.3 Hz

Data point: 65536

Measurement mode: Presat

Pulse width: 45°

Pulse delay time: 10 sec

Cumulative number: 128 times

Production of Internal Olefin

Production Example A1

(Production of Internal Olefin Having 16 Carbon Atoms (Internal Olefin 1))

A flask equipped with a stirrer was charged with 7000 g (28.9 mol) of 1-hexadecanol (Product name: KALCOL 6098, manufactured by Kao Corporation) and 700 g (10 wt % with respect to the raw material alcohol) of γ-alumina (STREM Chemicals, Inc.) as a solid acid catalyst, followed by reaction at 280° C. for 32 hours under stirring with circulation of nitrogen (7000 mL/min) in the system. The alcohol conversion after completion of the reaction was 100%, and the purity of C16 olefin was 99.6%. The obtained crude C16 internal olefin was transferred to a distiller, followed by distillation at 136 to 160° C./4.0 mmHg to yield an internal olefin 1 having an olefin purity of 100%. The double bond distribution in the obtained internal olefin 1 was 0.2% at the C1 position, 15.8% at the C2 position, 14.5% at the C3 position, 15.7, at the C4 position, 17.3% at the C5 position, 16.5%, at the C6 position, and 20.0% at the C7 position and the C8 position in total.

Production Example A2

(Production of Internal Olefin Having 18 Carbon Atoms (Internal Olefin 2))

A reactor equipped with a stirrer was charged with 800 kg (3.0 kmol) of 1-octadecanol (Product name: KALCOL 8098, manufactured by Kao Corporation) and 80 kg (10 wtC with respect to the raw material alcohol) of activated alumina GP-20 (Mizusawa Industrial Chemicals, Ltd.) as a solid acid catalyst, followed by reaction at 280° C. for 16 hours under stirring with circulation of nitrogen (15 L/min) in the system. The alcohol conversion after completion of the reaction was 100%, and the purity of C18 olefin was 98.7%. The obtained crude C18 internal olefin was transferred to a distiller, followed by distillation at 163 to 190° C./4.6 mmHg to yield an internal olefin 2 having an olefin purity of 100%. The double bond distribution in the obtained internal olefin 2 was 0.3% at the C1 position, 13.3% at the C2 position, 12.63 at the C3 position, 13.9% at the C4 position, 14.8% at the C5 position, 13.7% at the C6 position, 12.6% at the C7 position, and 18.8% at the C8 position and the C9 position in total.

Production of Internal Epoxide

Production Example B1

(Production of Internal Epoxide Having 16 Carbon Atoms (Internal Epoxide 1))

A flask equipped with a stirrer was charged with the internal olefin 1 (800 g, 3.56 mol) obtained in Production Example A1, 107 g (1.78 mol) of acetic acid (manufactured by Wako Pure Chemical Industries, Ltd.), 15.6 g (0.15 mol) of sulfuric acid (manufactured by Wako Pure Chemical Industries, Ltd.), 415.7 g (4.28 mol) of 35% hydrogen peroxide (manufactured by Wako Pure Chemical Industries, Ltd.), and 25.3 g (0.18 mol) of sodium sulfate (manufactured by Wako Pure Chemical Industries, Ltd.), followed by reaction at 50° C. for 4 hours. Thereafter, the temperature was raised to 70° C. to allow the mixture to react further for 2 hours. After the reaction, the layers were separated to remove an aqueous layer, and an oil layer was washed with ion-exchanged water, a saturated aqueous sodium carbonate solution (manufactured by Wako Pure Chemical Industries, Ltd.), a saturated aqueous sodium sulfite solution (manufactured by Wako Pure Chemical Industries, Ltd.), and 1% saline (manufactured by Wako Pure Chemical Industries, Ltd.), followed by concentration in an evaporator to yield 820 g of an internal epoxide 1.

Production Example B2

(Production of Internal Epoxide Having 18 Carbon Atoms (Internal Epoxide 2))

A flask equipped with a stirrer was charged with the internal olefin 2 (595 g, 2.38 mol) obtained in Production Example A2, 71.7 g (1.20 mol) of acetic acid (manufactured by Wako Pure Chemical Industries, Ltd.), 9.8 g (0.10 mol) of sulfuric acid (manufactured by Wako Pure Chemical Industries, Ltd.), and 324 g (4.00 mol) of 35% hydrogen peroxide (manufactured by Wako Pure Chemical Industries, Ltd.), followed by reaction at 50° C. for 4 hours. Thereafter, the temperature was raised to 80° C. to allow the mixture to react further for 5 hours. After the reaction, the layers were separated to remove an aqueous layer, and an oil layer was washed with ion-exchanged water, a saturated aqueous sodium carbonate solution (manufactured by Wako Pure Chemical Industries, Ltd.), a saturated aqueous sodium sulfite solution (manufactured by Wako Pure Chemical Industries, Ltd.), and ion-exchanged water, followed by concentration in an evaporator to yield 629 g of an internal epoxide 2.

<Production of Reactant of Epoxide and Glycerin (Alkyl Glyceryl Ether, AGE)>

Hereinafter, the alkyl glyceryl ether is referred to as AGE. In addition, AGE1, AGE2 and the like represent alkyl glyceryl ether 1, alkyl glyceryl ether 2 and the like, respectively.

Production Example C1

(Production of Reactant of Internal Epoxide 1 and Glycerin (AGE1))

A flask equipped with a stirrer was charged with 2298 g (25.0 mol) of glycerin (manufactured by Wako Pure Chemical Industries, Ltd.) and 0.122 g (1.25 mmol) of 98% sulfuric acid (manufactured by Wako Pure Chemical Industries, Ltd.), and the temperature was raised to 130° C. Thereafter, the internal epoxide 1 (300 g, 1.25 mol) obtained in Production Example B1 was added dropwise over 1 hour, followed by reaction at 130° C./8 hours. Hexane was added to the liquid obtained by this reaction, followed by washing with ion-exchanged water. Subsequently, concentration was performed under reduced pressure in an evaporator to yield 400 g of AGE1. The obtained AGE1 contained 73% ether alcohol 1 in which $R^1$ and $R^2$ each contained an alkyl group having 1 to 13 carbon atoms, the total number of carbon atoms of $R^1$ and $R^2$ was 14, X was a single bond, and A was —O—$CH_2$—CH(OH)—$CH_2$OH in the Chemical Formula (1) (AGE obtained by reacting the hydroxyl group at the 1-position of glycerin with the epoxy group), and 27% ether alcohol 2 in which $R^1$ and $R^2$ each contained an alkyl group having 1 to 13 carbon atoms, the total number of carbon atoms of $R^1$ and $R^2$ was 14, X was a single bond, and A was —O—CH(—$CH_2$—OH)$_2$ in the Chemical Formula (1) (AGE obtained by reacting the hydroxyl group at the 2-position of glycerin with the epoxy group).

Production Example C2

(Production of Reactant of Internal Epoxide 2 and Glycerin (AGE2))

An AGE2 was obtained in the same manner as in Production Example C1 except that the internal epoxide 2 (1.25 mol) obtained in Production Example B2 was used in place of the internal epoxide 1 (1.25 mol) obtained in Production Example B1. The obtained AGE2 contained 72% ether alcohol 1 in which $R^1$ and $R^2$ each contained an alkyl group having 1 to 15 carbon atoms, the total number of carbon atoms of $R^1$ and $R^2$ was 16, X was a single bond, and A was —O—$CH_2$—CH(OH)—$CH_2$OH in the Chemical Formula (1) (AGE obtained by reacting the hydroxyl group at the 1-position of glycerin with the epoxy group), and 28% ether alcohol 2 in which $R^1$ and $R^2$ each contained an alkyl group having 1 to 15 carbon atoms, the total number of carbon atoms of $R^1$ and $R^2$ was 16, X was a single bond, and A was —O—CH(—$CH_2$—OH)$_2$ in the Chemical Formula (1) (AGE obtained by reacting the hydroxyl group at the 2-position of glycerin with the epoxy group).

Examples 1 to 8, Comparative Examples 1 to 6

Each of oil agent additives described in Table 1 was added to each of oil agents described in Table 1 in an added amount described in Table 1, followed by sufficient mixing at 80° C. to prepare an oil agent composition. The oil agents and the oil agent additives described in Table 1 are as follows.

<Oil Agent>

Cosmo Neutral 150: paraffinic lubricating oil, manufactured by Cosmo Oil Lubricants Co., Ltd.

Toyota Pure ATF WS: Paraffinic lubricating oil, manufactured by Toyota Motor Corporation <Oil Agent Additive>

Additive 1: AGE1 produced in Production Example C1

Additive 2: AGE2 prepared in Production Example C2

Excel O-95R: pure vegetable molecular distilled monoglyceride (manufactured by Kao Corporation)

<Measurement of Melting Point of Oil Agent Additive>

Using a high sensitivity differential scanning calorimeter (manufactured by Hitachi High-Tech Science Corporation, trade name: DSC 7000X), each oil agent additive was placed in a 70 μL pan, the temperature was raised from −60° C. to 80° C. at 2° C./min, and the temperature at the maximum peak of the temperature difference detected by the differential thermal electrode with respect to the temperature raising time was defined as the melting point.

The following measurement and evaluation were performed using the oil agent compositions prepared in Examples and Comparative Examples.

<Measurement of Friction Coefficient>

Using an MTM2 traction measuring instrument (manufactured by PCS Instruments Ltd.), the friction coefficient of each of the prepared oil agent compositions was measured under the following measurement conditions. The results are shown in Table 1. It can be said that the smaller the friction coefficient is, the more excellent the fuel-saving performance is.

Measurement Conditions

Load: 50 N

Oil temperature: 80° C. or 120° C.

Slide/roll ratio: 50%

Average rotation speed: 10 $mm^2$/sec

<Storage Test>

Each of the prepared oil agent compositions was stored at 5° C., and the appearance after 1 day and 20 days was visually observed and evaluated according to the following criteria. The results are shown in Table 1.

○: The oil agent composition is transparent.

x: The compound is precipitated in the oil agent composition.

TABLE 1

| | Oil Agent | Oil Agent Additive: Type of Additive | Melting Point [° C.] | Added Amount [parts by mass*] | Content of Additive [mass %] | Friction Coefficient [10 mm²/s] 80 °C. | 120 °C. | Storage Test After 1 Day | After 20 Days |
|---|---|---|---|---|---|---|---|---|---|
| Example 1 | Cosmo Neutral 150 | Additive 1 | −18 | 0.5 | 0.5 | 0.065 | 0.072 | ○ | ○ |
| Example 2 | | | | 1.0 | 1.0 | 0.061 | 0.054 | ○ | ○ |
| Example 3 | | | | 2.0 | 2.0 | 0.056 | 0.048 | ○ | ○ |
| Example 4 | | Additive 2 | 1 | 0.5 | 0.5 | 0.068 | 0.070 | ○ | ○ |
| Example 5 | | | | 1.0 | 1.0 | 0.058 | 0.051 | ○ | ○ |
| Example 6 | | | | 2.0 | 2.0 | 0.066 | 0.070 | ○ | ○ |
| Example 7 | Toyota Pure ATF WS | Additive 1 | −18 | 1.0 | 1.0 | 0.052 | 0.047 | ○ | ○ |
| Example 8 | | Additive 2 | 1 | 1.0 | 1.0 | 0.055 | 0.052 | ○ | ○ |
| Comparative Example 1 | Cosmo Neutral 150 | — | — | — | — | 0.072 | 0.078 | ○ | ○ |
| Comparative Example 2 | Toyota Pure ATF WS | — | — | — | — | 0.061 | 0.062 | ○ | ○ |
| Comparative Example 3 | Cosmo Neutral 150 | Excel O-95R | 41 | 0.5 | 0.5 | 0.068 | 0.065 | × | × |
| Comparative Example 4 | | | | 1.0 | 1.0 | 0.066 | 0.064 | × | × |
| Comparative Example 5 | | | | 2.0 | 2.0 | 0.056 | 0.065 | × | × |
| Comparative Example 6 | Toyota Pure ATF WS | | | 1.0 | 1.0 | 0.053 | 0.051 | × | × |

*Parts by Mass with Respect to 100 Parts by Mass of Oil Agent

Table 1 shows that the oil agent compositions of Examples 1 to 8 have high quality because these compositions have low friction coefficients at 80° C. and 120° C., and do not precipitate the oil agent additive even when stored at a low temperature for a long period of time. On the other hand, the oil agents of Comparative Examples 1 and 2 have high friction coefficients at 80° C. and 120° C. This is because an oil agent additive is not added. The oil agent compositions of Comparative Examples 3 to 6 have relatively low friction coefficients at 80° C. and 120° C., but when stored at a low temperature, the oil agent additive precipitates. Accordingly, improvement is desired.

INDUSTRIAL APPLICABILITY

The oil agent additive of the present invention is useful as a friction reducing agent added to various oil agent compositions.

The invention claimed is:

1. An oil agent additive comprising at least one kind of a compound represented by a Chemical Formula (1):

[Chemical Formula (1)]

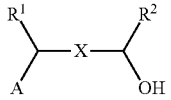

wherein $R^1$ and $R^2$ are each an aliphatic hydrocarbon group having 1 or more and 33 or less carbon atoms, a total number of carbon atoms of $R^1$ and $R^2$ is 2 or more and 34 or less, X is a single bond or an aliphatic hydrocarbon group having 1 or more and 5 or less carbon atoms, and A is —O—$CH_2$—CH(OH)—$CH_2$OH or —O—CH(—$CH_2$—OH)$_2$.

2. The oil agent additive according to claim 1, wherein in the compound represented by the Chemical Formula (1), X is a single bond.

3. The oil agent additive according to claim 1, comprising a compound 1 in which A is —O—$CH_2$—CH(OH)—$CH_2$OH in the Chemical Formula (1) and a compound 2 in which A is —O—CH(—$CH_2$—OH)$_2$ in the Chemical Formula (1).

4. The oil agent additive according to claim 3, wherein a content of the compound 1 is 1 mass % or more and 99 mass % or less with respect to a total of the compound 1 and the compound 2.

5. The oil agent additive according to 4 claim 1, wherein a melting point of the compound represented by the Chemical Formula (1) is 30° C. or less.

6. The oil agent additive according to claim 1, wherein the total number of carbon atoms of $R^1$ and $R^2$ is 12 or more and 22 or less.

7. The oil agent additive according to claim 1, wherein $R^1$ and $R^2$ are each a linear or branched alkyl group.

8. An oil agent composition comprising the oil agent additive according to claim 1 and an oil agent.

9. The oil agent composition according to claim 8, wherein the oil agent is a lubricating oil.

10. The oil agent composition according to claim 9, wherein the lubricating oil is an engine oil or a gear oil.

11. The oil agent composition according to claim 9, wherein the lubricating oil is a paraffinic lubricating oil.

12. The oil agent composition according to claim 8, wherein a content of the oil agent additive in the oil agent composition is 0.05 mass % or more and 20 mass % or less.

13. Use of the oil agent additive according to claim 1 as a lubricating oil additive.

14. Use of the oil agent additive according to claim 1 as a friction coefficient reducing agent.

15. Use of the oil agent additive according to claim 1 for reducing a friction coefficient of an engine or a gear.

16. The oil agent additive according to claim 1, comprising two or more kinds of the compound in which X is a single bond, and between which the total numbers of carbon atoms of $R^1$ and $R^2$ are the same, but the numbers of carbon atoms of $R^1$ and the numbers of carbon atoms of $R^2$ are each different.

17. The oil agent additive according to claim 1, comprising two or more kinds of the compound in which X is a single bond and between which the total numbers of carbon atoms of $R^1$ and $R^2$ are different, wherein a total content of the compound in which the total number of carbon atoms of $R^1$ and $R^2$ is 14 and the compound in which the total number of carbon atoms of $R^1$ and $R^2$ is 16 is 75 mass % or more.

18. The oil agent additive according to claim 1, comprising two or more kinds of the compound between which the total numbers of carbon atoms of $R^1$ and $R^2$ are the same, but the numbers of carbon atoms of $R^1$ and the numbers of carbon atoms of R are each different, wherein a content ratio of the compound in which $R^1$ has 5 or more carbon atoms and $R^2$ has 5 or more carbon atoms is 10 mass % or more and 90 mass % or less.

19. The oil agent additive according to claim 1, wherein a melting point of the compound represented by the Chemical Formula (1) is 30° C. or lower and −200° C. or higher.

20. The oil agent composition according to claim 8, wherein a melting point of the oil agent is −200° C. or higher and −15° C. or lower.

* * * * *